US005615461A

United States Patent [19]

Tominaga et al.

[11] Patent Number: 5,615,461

[45] Date of Patent: Apr. 1, 1997

[54] FASTENING DEVICE

[75] Inventors: Yutaka Tominaga; Toshiaki Takizawa; Ryuichi Murasaki, all of Toyama, Japan

[73] Assignee: YKK Corporation, Tokyo, Japan

[21] Appl. No.: 352,725

[22] Filed: Dec. 2, 1994

[30] Foreign Application Priority Data

Dec. 8, 1993 [JP] Japan ..... 5-308340

[51] Int. Cl.[6] ..... A44B 18/00

[52] U.S. Cl. ..... 24/452; 24/442; 160/330

[58] Field of Search ..... 24/306, 442, 716, 24/452, 450, 446, 447, 448, 444, 453, 297; 160/330, 345, 368 T; 16/87.2, 87.4 R

[56] References Cited

U.S. PATENT DOCUMENTS 3,147,528 9/1964 Erb ..... 24/452
4,766,652 8/1988 Sugiura ..... 24/453

FOREIGN PATENT DOCUMENTS 0464754 1/1992 European Pat. Off. .
0499461 8/1992 European Pat. Off. .
0612493 8/1994 European Pat. Off. .
0619970 10/1994 European Pat. Off. .

*Primary Examiner*—Blair Johnson
*Attorney, Agent, or Firm*—Hill, Steadman & Simpson

[57] ABSTRACT

A fastening device molded of a synthetic resin material and adapted to be engaged with a large number of loops on one surface of a fastener part of a mating member includes a base member having on its one surface a large number of hooks integrally molded with the base member and arranged in a plurality of rows. The hooks in each hook row generally have the same hook direction aligned with an axis of the hook row, and the hooks in one hook row and the hooks in an adjacent hook row do not always have the same hook direction. At least one hook in each hook row which is adjacent to a peripheral edge of the base member have a hook direction facing outwardly away from the peripheral edge. With this arrangement, the hooks located adjacent to the peripheral edge are capable of withstand undue force tending to fatigue and eventually break the hooks.

15 Claims, 8 Drawing Sheets

FASTENING DEVICE

BACKGROUND OF THE INVENTION

1. Field of the Invention

The present invention relates to a fastening device or fastener, such as a screen hanging fastener for connecting a curtain rail and various hanging screens such as a curtain, or an interior finish material fastener interposed between a mounting member such as a ceiling, a floor surface or a panel of the room interior, and a plate member such as a mat, a carpet, a wall covering material, a ceiling covering material or a dashboard for securely attaching the mounting member and the plate member.

2. Description of the Prior Art

Most curtains used in hospitals and hotels are held under a lease and they are replaced and laundered periodically. To improve the efficiency of the curtain replacement work, an appropriate measure should be taken to facilitate the attachment and detachment of curtains. To cope with this requirement, Japanese Utility Model Laid-open Publication No. HEI 4-104909, for example, discloses a prior proposal made to enable easy attachment and detachment of a curtain relative to curtain runners mounted on a curtain guide member, such as a curtain rail or a guide bar. A screen hanging fastener according to the prior proposal is composed of a plate-like fastening device made from a synthetic resin and including a number of hooks arranged in a plurality of rows and integrally molded on the face of a base member, and a metal hook portion formed from two metal wires and integrally molded in an upper portion of the base member for releasable engagement with a curtain runner. The hooks are molded such that they are aligned in the vertical, horizontal and diagonal direction and form a plurality of rows of hooks arranged in the widthwise direction of the fastening device. The hooks in each hook row are aligned with an axis of the hook row and have the same direction of bend or hook (hereinafter referred to as "hook direction"). The hooks in each pair of adjacent rows have either the same hook direction, or alternatively opposite hook directions. In the fastening devices of this type, in order to support a curtain in a vertically suspended condition, the hooks in the most part of the hook rows generally have a hook direction facing upwards, as shown in FIG. 10(A), to secure a desired fastening strength.

On the other hand, to various mounting members, such as a ceiling, a floor surface and a door panel of an automobile, and a wall, a ceiling and a floor surface of a building various interior finish materials are attached mostly by use of a surface-type fastener generally known as "hook-and-loop" fastener. Male and female fastener parts of the surface-type fastener are attached to the mounting member and the interior finish material, respectively, and vice versa, by means of ultrasonic welding or pressure-sensitive adhesion bonding. However, due to insufficient durability and bonding strength, there has been used a fastening device of synthetic resin which includes a number of hooks projecting from the face of a plate-like base member, and a stud-like projection disposed on the back of the base member and having a resilient locking head portion provided with a pair of wings. The resilient locking head portion is resiliently deflected as it is forced into a hole in the mounting member. When the resilient locking head portion moves past the hole, it springs back into the original shape so that the mounting member is firmly gripped from its face and back sides between the base member and the resilient locking head portion of the fastening device.

Known interior finish material fastening devices of the type described are disclosed, for example, in Japanese Patent Publication No. SHO 51-651, Japanese Utility Model Publication No. SHO 54-26089 and Japanese Utility Model Laid-open Publication No. SHO 57-31250. As is understood from these publications, these fastening devices are widely used not only in the automobiles but also in the interior finish work of buildings. Furthermore, in one form of application proposed recently in Japanese Utility Model Laid-open Publication No. HEI 3-21285, the resilient locking head portion of the fastening device is used as a runner for curtain rail.

In the interior finish material fastening devices or fasteners of the type described, in order to avoid producing the directionality in the fastening strength, the face of the base member is generally separated into a plurality of blocks each including a plurality of rows of hooks arranged such that the hooks in each hook row have the same hook direction, the hooks in the adjacent hook rows have opposite hook directions, and the hook direction of one hook block is perpendicular to the hook direction of an adjacent hook block.

The screen hanging fastener disclosed in Japanese Utility Model Laid-open. Publication No. HEI 4-104909 is advantageous in that since a fastener piece having on its face side a number of hooks is a molded product, the fastening strength of a surface-type fastener can be increased to such an extent much greater than that obtained by conventional hooks formed by weaving or knitting a monofilament. However, a drawback is that the metal hook portion requires a manufacturing process to be achieved separately from the molding of the screen hanging fastener. In addition, the injection-molding process is rendered complicated by the metal hook portion because the metal hook portion must be inserted in a portion of the molded product. From the viewpoint of final products, the metal hook portion increases the product cost. In addition, since the curtain runners are mostly made from synthetic resin, they are likely to be severely worn away by the metal hook portions and hence cannot withstand a long period of use. Furthermore, the metal hook portion and the synthetic resin fastener piece which are made from different materials are not well-matched in appearance and cannot readily be chromatically coordinated under the same color tone.

In the case of the interior finish material fastener, the stud-like projection is forced into the hole in the mounting member against the resiliency of the winged interlocking head portion. When the head portion is moved past the hole, the winged interlocking head portion springs back into its original shape with the result that the mounting member is gripped from its face and back sides between the plate-like base member and the winged interlocking head portion. In this instance, if the back side of the mounting member is irregular due to the presence of a burr or projection which may be produced at the time of forming the hole, the interior finish material fastener might be incompletely attached to the mounting member, with the winged interlocking head portion left within the hole due to interference with the burr or projection. With this incomplete attachment, an interior finish material attached via the interior finish material fastener to the mounting member is easily detached from the mounting member when it is subjected to a force tending to separate the interior finish material and the mounting member. This deficiency may be overcome by providing a space between the base member and the winged resilient interlocking head portion, which space is equal to the sum of the thickness of the mounting member and the height of the burr or projection. The space thus provided, however, would cause a problem that when the back side of the mounting member is flat at least in an area around the hole, the interior finish material fastener is freely movable in the axial direction of the hole within some distance, thus producing wobbling between the mounting member and the interior finish material.

In the aforesaid prior screen hanging fastener, the hooks in the plural hook rows are all directed upwardly. On the other hand, in the aforesaid interior finish material fastener, the hooks in the plural hook rows (about ½ of the whole hook rows) are directed inwardly of the peripheral edge of the base member.

Regarding the screen hanging fastener, the weight of a curtain is mostly born by these hooks which are disposed along a lower edge of the screen hanging fastener. These hooks are subjected to a greater load than other hooks and hence they are gradually fatigued by repeated curtain attachment and detachment operations. Eventually, when the curtain is peeled off from its top edge, hooks in the lowermost tier and hooks in the second tier from the bottom as well are liable to be broken, as shown in FIG. 10(A). This is because due to the absence of the hooks and the base member which support or back up the hooks against bending, the hooks in the first and second tiers from the bottom are bent to a greater extent than other hooks and hence are susceptible to fatigue and breakdown.

In the case of the interior finish material fastener, a mating fastener member is supported mainly by these hooks which are disposed along the peripheral edge of the base member, as shown in FIG. 10(B). Consequently, these hooks are liable to become fatigued to a greater extent than other hooks when they are subjected to a repeated load. When the mating fastener member is separated from the interior finish material fastener, the mating member is progressively peeled off from the peripheral edge toward a central portion of the base member. Since the hooks in the hook rows have a direction facing inwardly from the peripheral edge of the base member, as shown in FIG. 10(B), they are only able to show a limited or relatively low peeling resistance at the initial stage of peeling or separation. The peeling strength of the overall fastener is reduced, accordingly.

SUMMARY OF THE INVENTION

In view of the drawbacks of the prior art described above, it is an object of the present invention to provide fastening devices having structural features which are able to prevent breakage of those hooks located along a peripheral edge of the fastening device and secure a desired peeling strength while maintaining the advantageous features of the prior fastening device molded of synthetic resin.

The foregoing object can be attained by a fastening device adapted to be engaged with a fastener part of a mating member including a large number of loops on one surface of the fastener part. The fastening device includes a base member having on its one surface a number of hooks integrally molded with the base member and arranged in a plurality of rows. The hooks in each hook row generally have the same hook direction aligned with an axis of the hook row, and the hooks in one hook row and the hooks in an adjacent hook row do not always have the same hook direction. At least one hook in each hook row, and preferably two adjacent hooks in the same hook row which are adjacent to a peripheral edge of the base member have a hook direction facing outwardly away from the peripheral edge.

According to one preferred embodiment of this invention, the mating member is a hanging screen, such as a curtain, and the fastening device further includes a round hook portion having a neck formed integrally with an upper end of the base member. Those hooks which are disposed along a lower end edge of the base member have a hook direction facing downwards. The round hook portion has an opening defined between the neck and a tip end of the round hook portion. The round hook portion further preferably includes a beak-like straight portion contiguous to the tip end and extending radially outwardly therefrom substantially at right angles to the round hook portion.

According to another preferred embodiment of this invention, the fastening device is attached to a mounting member before it is engaged with the looped fastener portion on one surface of the mating member composed of an interior finish material to attach the interior finish material to the mounting member. The base member has a certain degree of rigidity, and the hooks on the one surface of the base member are arranged in a number of rows. In each of these hook rows extending perpendicular to a peripheral edge of the base member, all of at least an outermost hooks located adjacent to the peripheral edge have a hook direction facing outwards of the peripheral edge. The fastening device further includes a stud-like projection disposed centrally on the other surface of the base member and including a wing-like resilient locking portion formed on a front end of the stud-like projection for locking engagement with the mounting member. The resilient locking portion is preferably composed of at least two pairs of wings disposed in parallel juxtaposition on the front end of the stud-like projection, and one of two adjacent ones of the resilient wings is longer than the other. The resilient locking portion is adapted to be forced through an opening in the mounting member to attach the fastening device to the mounting member.

In the case where the fastening device is used in a loose or untied state as a curtain hanging fastener, a necessary number of curtain runners are slidably mounted on a curtain rail, and a hook portion of the curtain hanging fastener is hooked on a ring of each of the curtain runner. Then, the fastener surfaces of the respective female fastener tape pieces attached along the top edge of the curtain at regular intervals are forced one by one against the fastener surfaces of the hooked curtain hanging fasteners to attach the curtain to the curtain rail.

When the curtain hung by the curtain hanging fastener is to be separated from the curtain hanging fastener, the top edge of the curtain is progressively peeled in a downward direction. In this instance, since the peeling direction is the same as the direction of hooks located at the lower end of the curtain hanging fastener, the curtain can be peeled off with utmost smoothness without applying undue force to the hooks disposed adjacent to the lower end. The hooks are, therefore, able to withstand a long period of use. During the peeling operation, the weight of the curtain may temporarily concentrate on these hooks which are located immediately above the downwardly directed hooks and are directed upwardly. At this moment, however, partly due to the downwardly directed hooks disposed below the upwardly directed hooks, and partly due to a portion of the base member extending downwardly from the upwardly directed hooks, the upwardly directed hooks are supported or backed up from the below and hence are prevented from flexing or bending downwardly to a greater extent leading to fracture or breakage. Accordingly, the upwardly directed hooks are unlikely to become fatigued under a repeated attaching and detaching operation and hence can successfully endure a long period of use without causing breakage. In general, a portion of the curtain which is engaged with the lower end of the curtain hanging fastener is subjected to forces applied in various different directions. For instance, when the curtain is subjected to an external force tending to separate the curtain from the lower end of the curtain hanging fastener, the downwardly facing hooks located near the lower end of the curtain hanging fastener act as a resistance to the external force, thus making it difficult to separate the curtain from the curtain hanging fastener.

The hook portion of the curtain hanging fastener is rounded and has a mouth or opening defined between a neck and a tip end of the hook portion. The hook portion further has a beak-like straight portion formed integral with a tip end of the round hook portion and projecting radially outwardly from the tip end at right angle to the round hook portion. The round hook portion having such beak-like straight portion can readily be hooked on the curtain runner.

In the case where the fastening device of this invention is used as an interior finish material fastener for attaching an interior finish material to a mounting portion of an automobile, in each row of hooks extending perpendicular to the peripheral edge of a base member, at least an outermost hook located adjacent to the peripheral edge is directed outwardly of the peripheral edge. Accordingly, an external force exerted on the interior finish material is born evenly by all of the outermost hooks extending along the peripheral edge. The outermost hooks are, therefore, unlikely to become fatigued. Further, when the interior finish material is progressively peeled off in a direction from the peripheral edge toward a central portion of the base member, the outwardly directed outermost hooks in one row exhibit a greater initial peeling resistance and eventually increase the overall peeling strength of the fastener even when the rest of the hooks in the same row is directed inwardly of the peripheral edge.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

A typical embodiment of a curtain hanging fastening device or fastener according to the present invention will be first described below in greater detail with reference to the accompanying drawings. As will become apparent from the following description, the invention should by no means be limited to the illustrated embodiment. More particularly, in the illustrated embodiment, the curtain hanging fastener 4 has a large number of hooks 43 arranged in vertical rows R of nine. The nine hook rows R are divided sideways into three groups by two linear elongated flat lands 43*b* each extending between an outer group composed of two adjacent hook rows, and a central group composed of five consecutive hook rows. The flat lands 43*b* may be formed discretely at positions each corresponding to the position of an ejector pin (not shown but described later). In the illustrated embodiment, the hooks in the central five hook rows are all directed upwardly with the exception described later and generally have a hook direction facing upwards. The hooks in an inner one of the two adjacent rows which is adjacent to the central five hook rows via the flat land are all directed downwardly and have a hook direction facing downwards, while the hooks in the other hook row which is remote from the central five hook rows are all directed upwardly with the exception described later and generally have a hook direction facing upwards. The combination of the hook directions should by no means limited to the illustrated embodiment but may be changed in various ways as occasion demands. As a further alternative, a hooked fastener surface formed by the hooks 43 may be divided vertically and horizontally into a plurality of hooked fastener sections each including a multiplicity of hooks having one hook direction which is different from the hook direction of the hooks in an adjacent hooked fastener section.

Figure 1:
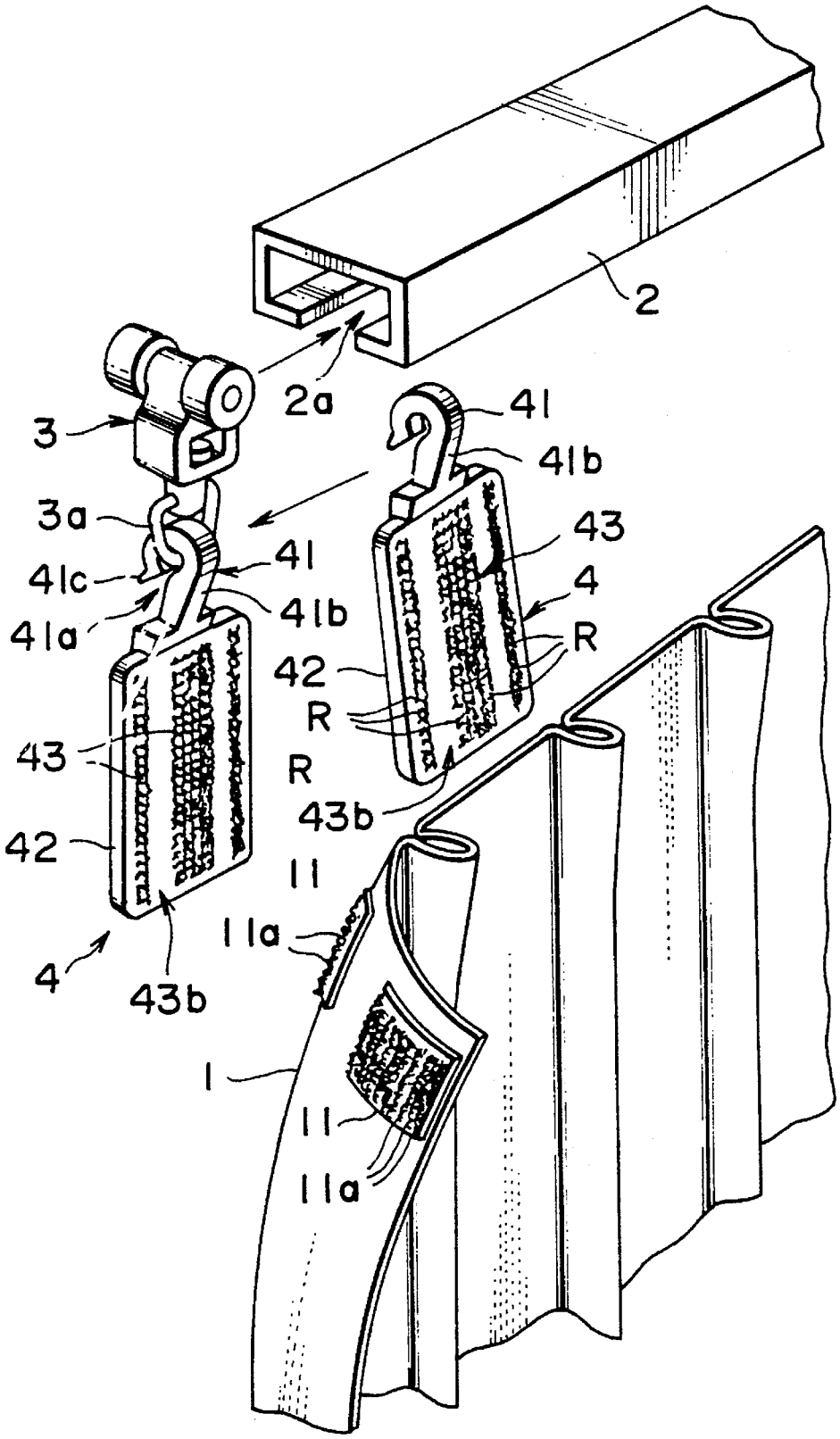
FIG. 1 is a perspective view illustrative of the manner in which a curtain is attached to a curtain rail with the use of a fastening device according to one embodiment of the present invention.

FIG. 1 is an exploded perspective view showing a curtain attachment structure in which the curtain hanging fastener 4 of this invention is used. Designated by 1 is a curtain including a plurality of pieces 11 of female or looped fastener tape attached along a top edge thereof at predetermined regular intervals. Numeral 2 is a curtain rail constituting a guide member. The curtain rail 2 is composed of an elongated C-section bar having a slit-like opening 2*a* extending longitudinally in a bottom wall throughout the length thereof.

According to the illustrated embodiment, the curtain hanging fastener 4 of this invention is composed of a round hook portion 41 adapted to be hooked on a ring 3*a* of a curtain runner 3, and a rectangular plate-like base member 42. The base member 42 has a large number of hooks 43 projecting from one surface of the base member 42. The hooks 43 are arranged in vertical rows R and horizontal tiers. In the illustrated embodiment, the total number of the hook rows R is nine which are divided into three groups; a central group composed of five consecutive vertical hook rows, and left and right side groups each composed of two adjacent vertical hook rows and spaced transversely from the central hook row groups by a predetermined distance.

The curtain hanging fastener 4 of the present invention is characterized in that the plate-like base member 42 and the hooks 43 are integrally molded of a synthetic resin material, and in that the hook directions of the respective hook rows R are arranged uniquely, and the hook portion 41 has a uniquely profiled mouth or opening 41*a*. In the embodiment shown in FIGS. 1–3, the hooks 43 in the central five hook rows R are all directed upwardly except that these hooks 43*a* which stand in the first and second tiers from the bottom are directed downwardly. The hooks 43 in an inner one of the two adjacent hook rows R in the left or the right side group are all directed downwardly, while the hooks 43 in the other of the two adjacent hook rows R are all directed upwardly with the exception that two hooks standing in the first and second tiers from the bottom are directed downwardly. Thus, all the hooks 43*a* which form at least two consecutive tiers from the bottom are directed downwardly. Excepting the hook direction of the hooks 43*a*, the hook directions of the respective rows R of hooks 43 may be combined otherwise than as specifically described with respect to the illustrated embodiment.

Figure 5:
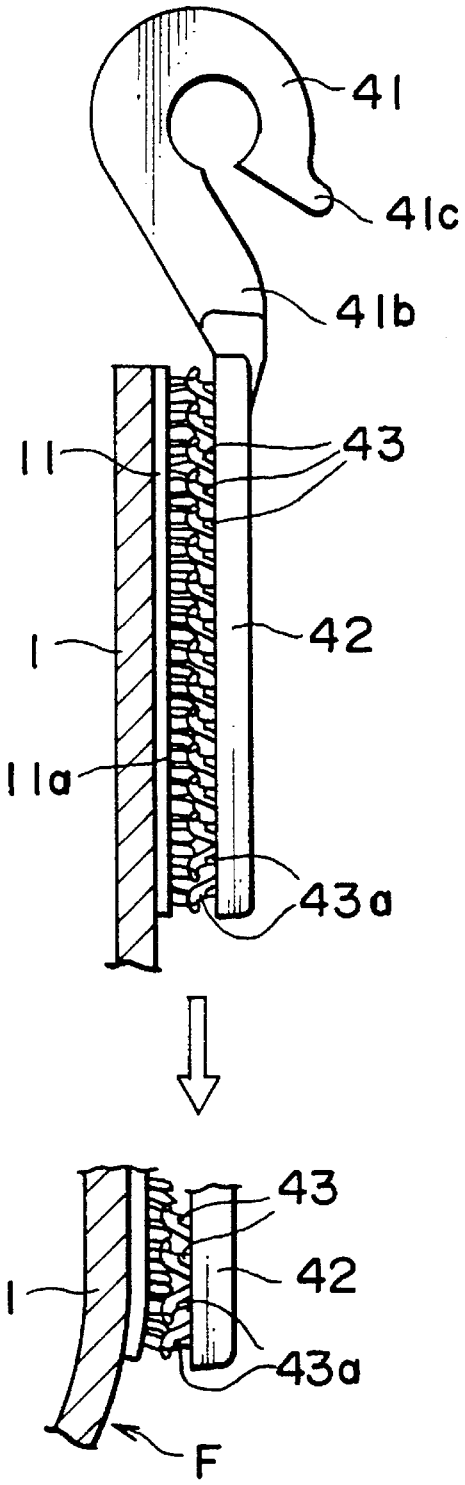
FIG. 5 is a side view explanatory of the operation of the fastening device.

With this arrangement, when the curtain 1 is to be separated from the curtain hanging fastener 4, the top edge of the curtain 1 is progressively peeled off in a downward direction. In this instance, since the peeling direction is the same as the hook direction at the lower end of the curtain hanging fastener 4, the curtain 1 can be peeled off with utmost smoothness without exerting undue force on the hooks 43*a* disposed adjacent to the lower end. The hooks 43*a* are, therefore, reliably operable for a long period of use without causing accidental breakage. During the peeling operation, the weight of the curtain 1 may temporarily concentrate on the hooks 43 in the third tier from the bottom. At this moment, however, partly due to the presence of the hooks 43*a* in the first and second tiers from the bottom, and partly due to the presence of the base member 42 extending further downwards from the hooks 43 in the third tier from the bottom, the hooks 43 in the third tier from the bottom are supported or backed up from the below and hence are prevented from flexing or bending downwardly to a greater extent leading to fracture or breakage. Accordingly, the hooks 43 in the third tier from the bottom are unlikely to become fatigued under a repeated attaching and detaching operation and hence can endure a long period of use. In general, a portion of the curtain 1 which is engaged with the lower end of the curtain hanging fastener 4 is subjected to forces applied in various different directions. For instance, when the curtain 1 is subjected to an external force tending to separate the curtain 1 from the lower end of the curtain hanging fastener 4, as shown in FIG. 5, the downwardly facing hooks 43*a* located near the lower end of the curtain hanging fastener 4 act as a resistance to the external force, thus making it difficult to separate the curtain 1 from the curtain hanging fastener 4.

Figure 2:
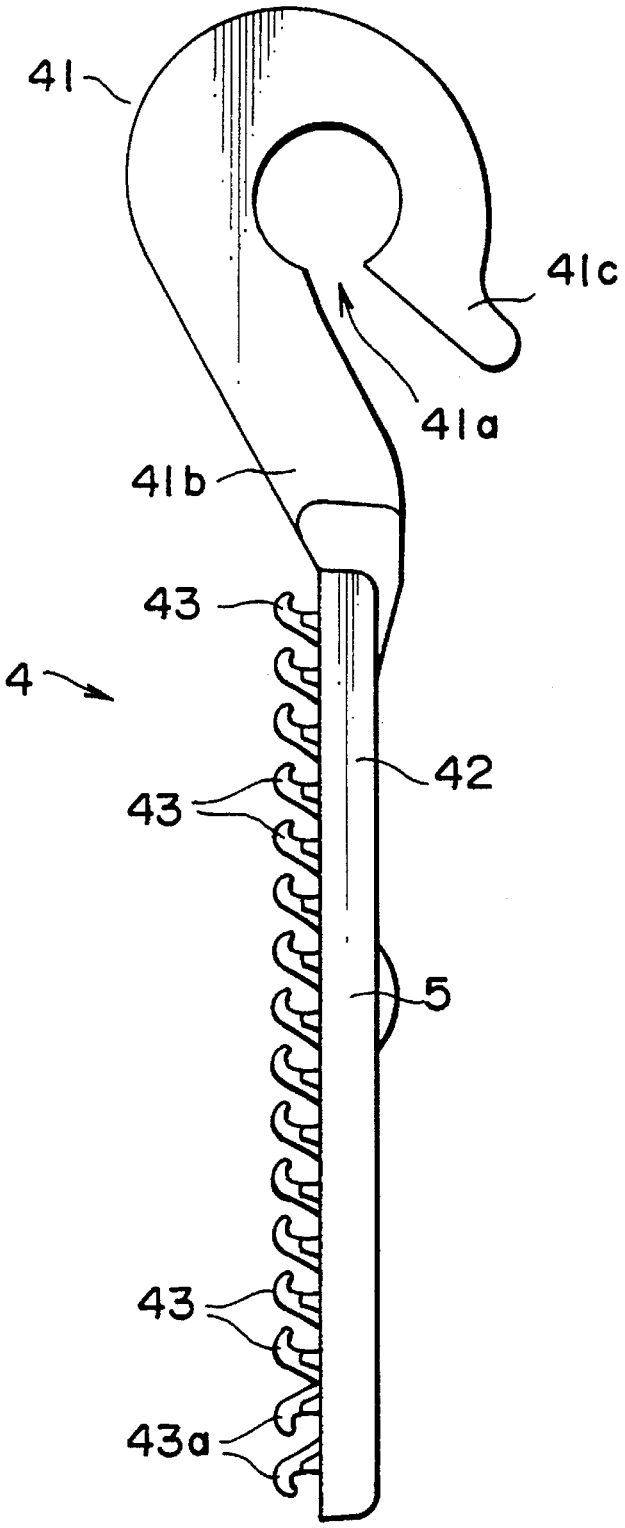
FIG. 2 is an enlarged side view showing an embodiment in which a plurality of similar fastening devices are interconnected by a cord.

As best shown in FIG. 2, the round hook portion 41 is joined via a neck 41*b* with the upper end of the base member 42 and has a substantially arcuate shape. The hook portion 41 has a mouth or opening 41*a* defined between the neck 41*b* and a tip end of the arcuately shaped hook portion 41. The hook portion 41 further has a beak-like straight portion 41*c* contiguous to the tip end and projecting radially outwardly from the arcuately shaped hook portion 41. With the beak-like straight portion 41*c* thus provided, the hook portion 41 can readily be hooked on the ring 3*a* of the curtain runner 3 (FIG. 1). It is obvious that the shape and configuration of the hook portion 41 are not limited to the illustrated embodiment but various changes and modifications are possible.

Figure 3:
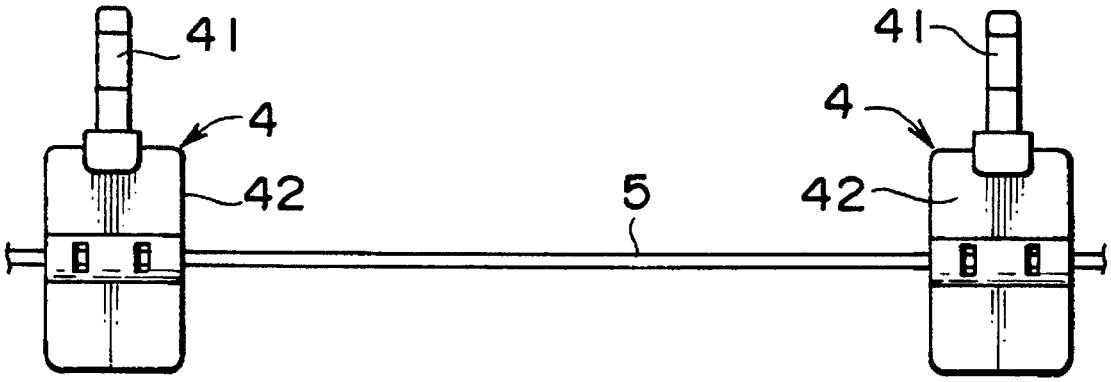
FIG. 3 is a rear view on reduced scale of FIG. 2.
Figure 4:
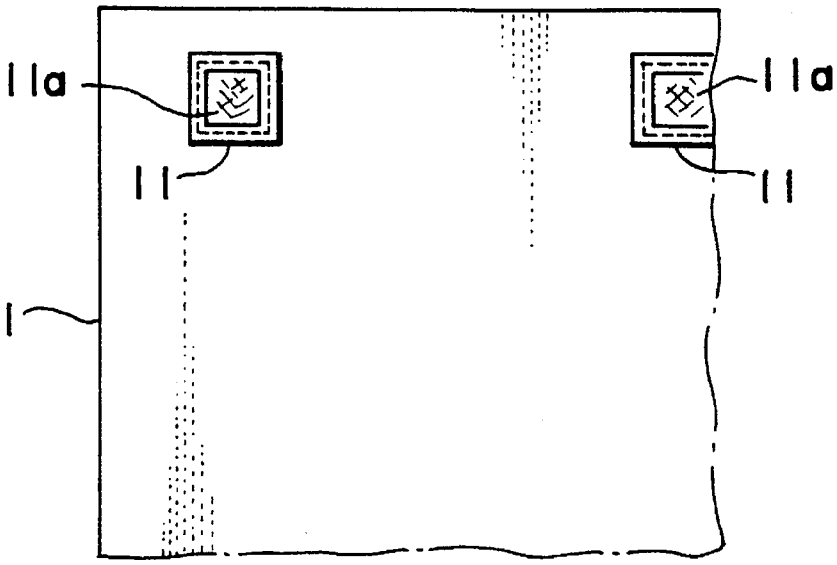
FIG. 4 is a schematic front elevational view showing a portion of the top edge of a curtain to be attached by the fastening device of the invention.

In the embodiment shown in FIG. 1, the curtain hanging fastener 4 is composed of a single part. The present invention also covers another form of application in which a plurality of curtain hanging fasteners 4 are interconnected at predetermined regular intervals by means of at least one cord 5, as shown in FIGS. 2 and 3. In the latter case, the hook portion 41 of each of the curtain hanging fastener 4 has the same construction as described above and performs the same function as described above. The cord 5 may include a synthetic resin filament, a synthetic fiber yarn, a braided rope, a tape and the like and has a necessary degree of strength and flexibility. In a practical application, the interval between each pair of adjacent female fastener tape pieces 11 having loops 11*a* and attached along the top edge of the curtain 1 is preferably greater than the interval between each pair of adjacent interconnected curtain hanging fasteners 4 by a desired distance. With this arrangement, when the curtain hanging fasteners 4 are attached successively one at a time to the corresponding female fastener tape pieces 11 on the curtain 1, a portion of the curtain 1 extending between each pair of adjacent female fastener tape pieces 11 is folded or warped by a distance equal to the difference in interval or pitch between the female fastener tape pieces 11 and the curtain hanging fasteners 4. The curtain portions thus folded automatically form pleats on the curtain 1.

To interconnect the plural curtain hanging fasteners 4 by the cord 5, the curtain hanging fasteners 4 are molded successively, with the cord 5 integrally molded in the respective base members 5. More specifically, a mold for injection molding is provided having a cavity for molding a base member 42 and a guide channel for the passage therethrough of the cord 5. The cord 5 guided in the guide channel is advanced intermittently, and in synchronism with this intermittent advancing movement of the cord 5, a molten synthetic resin material is repeatedly injected into the cavity to form base members 42 in succession. As a consequence, a series of laterally spaced curtain hanging fasteners 4 integrally molded on the continuous cord 5 at predetermined regular intervals are produced.

Now, a process for molding the curtain hanging fastener 4 of FIG. 1 will be described below in brief. The molding process is achieved by use of a mold assembly. The mold assembly is composed of a fixed mold having a cavity for molding a backside part of the curtain hanging fastener 4, a movable mold having a cavity for molding a face side part of the base member 5, a split mold disposed on a mold surface of the movable mold and composed of two mold parts jointly defining a cavity for molding the hook portion 41, and a group of split molds disposed on the mold surface of the movable mold and each composed of two mold parts jointly defining a series of cavities for molding one row of hooks 43, 43*a*. In operation, the movable mold and the associated split mold groups are moved toward the fixed mold to close the mold assembly. Then, a melted synthetic resin material is injected through a sprue and runners into the cavities in the mold assembly. After the elapse of a predetermined cooling time, the mold assembly is opened whereupon the split mold for molding the hook portion 41 and the split mold groups for molding the hooks 43, 43*a* are opened first, whereby a molded product is placed in a condition for removal from the mold assembly. In this instance, however, since a hook portion 41 and hooks 43, 43*a* on the base member 41 are left by adhesion within the corresponding cavities of the split molds, the molded product cannot be smoothly removed from the movable mold unless an external force is exerted on the molded product. Accordingly, after the mold assembly is opened, ejector pins are driven through the movable mold into pressure contact with left and right elongated flat surface portions between the rows of hooks 43, 43*a* of the molded product, thereby thrusting the molded product out from the mold assembly. Thus, to ensure smooth removal of the molded product from the mold assembly, the curtain hanging fastener 4 of this embodiment has on its face side two elongated flat surface portions which are devoid of the hooks 43, 43*a* and accept the thrusting action of the ejector pins. In the illustrated embodiment, the elongated flat surface portions coactive with the ejector pins are composed of left and right flat lands 43*b* (FIG. 1). And as described above, the flat lands 43*a* are formed respectively between the left side hook row group composed of two adjacent vertical hook rows R, and the central hook row group composed of five consecutive vertical hook rows R, and between the central hook row group and the right side hook row group composed of two adjacent vertical hook rows R.

Since the hook portion 41 and the base member 42 are integrally molded by a single injection molding run, the curtain hanging fastener 4 can be produced efficiently. In addition, by virtue of the flat lands 43*b*, the molded curtain hanging fastener 4 can be smoothly and reliably removed by the ejector pins from the mold assembly without damaging the hooks 43, 43*a* due to interference between the hooks 43, 43*a* and the ejector pins. In addition, since the hook portion 41 and the base member 42 are made from the same material, they can readily be colored in the same color tone. Furthermore, the hook portion 41 which is molded of a synthetic resin material does not damage the mating curtain runner 3 molded of synthetic resin and guarantees the prescribed durability of the curtain runner 3.

In the embodiments described above, the female surface-type fastener members 11 attached along the top edge of the curtain 1 are composed of a female fastener tape pieces each having a large number of loops 11*a* of fiber formed by weaving or knitting. In place of the looped fastener tape pieces 11, it is possible to use injection-molded fastener pieces each having the same construction as the base member 42 of the curtain hanging fastener 4 of the present invention. In this instance, however, care should be taken to arrange that the direction of the hooks on the surface-type fastener members attached to the curtain 1 is opposite to the direction of hooks 43 on the curtain hanging fasteners 4. Moreover, the hooks on the surface-type fastener members on the curtain 1 should preferably be directed downwards to produce a fastening force highly resistant to accidental separation caused by the action of the weight of the curtain 1.

Figure 6:
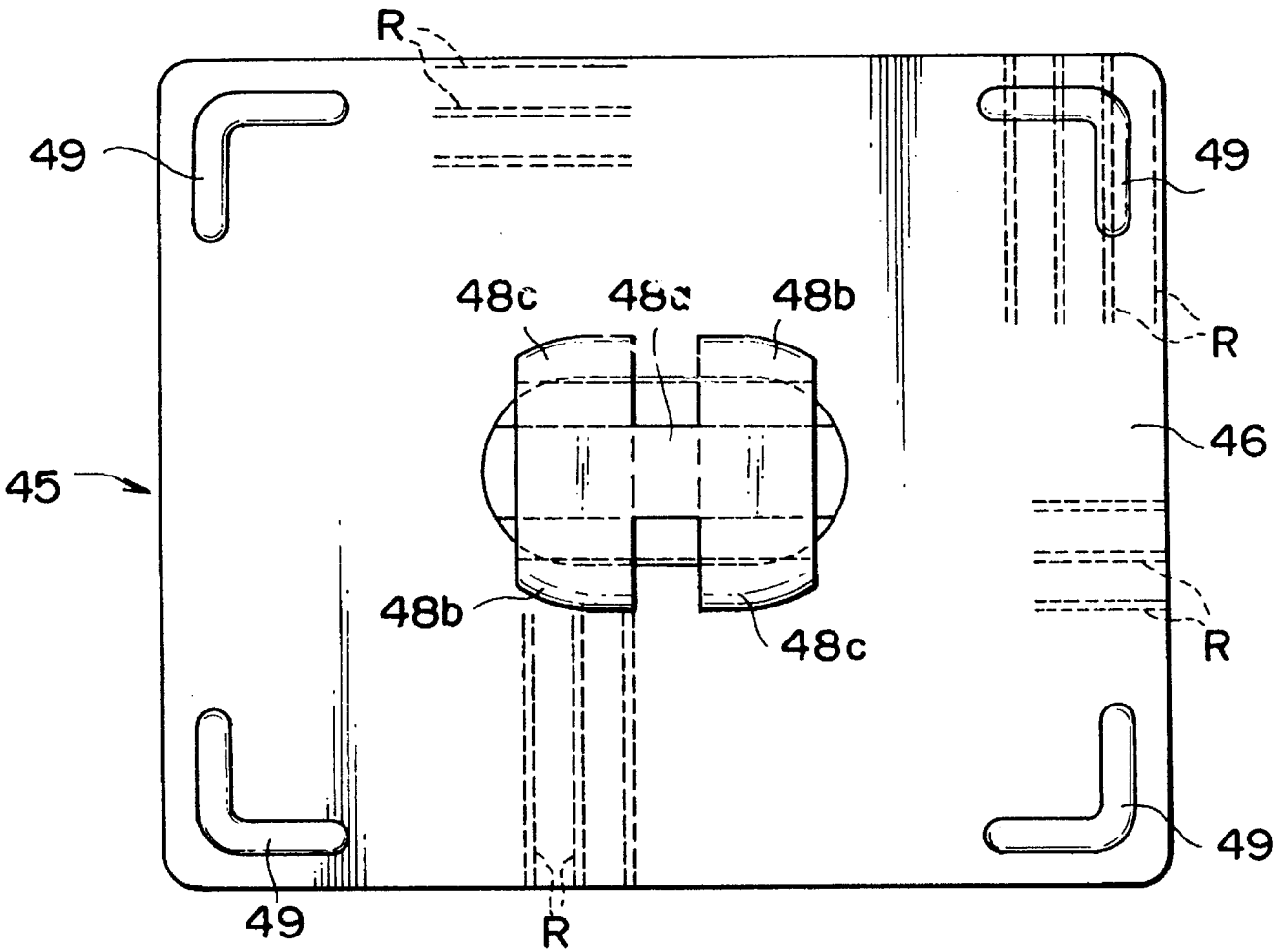
FIG. 6 is a plan view of an interior finish material fastening device according to an embodiment of the present invention.
Figure 7:
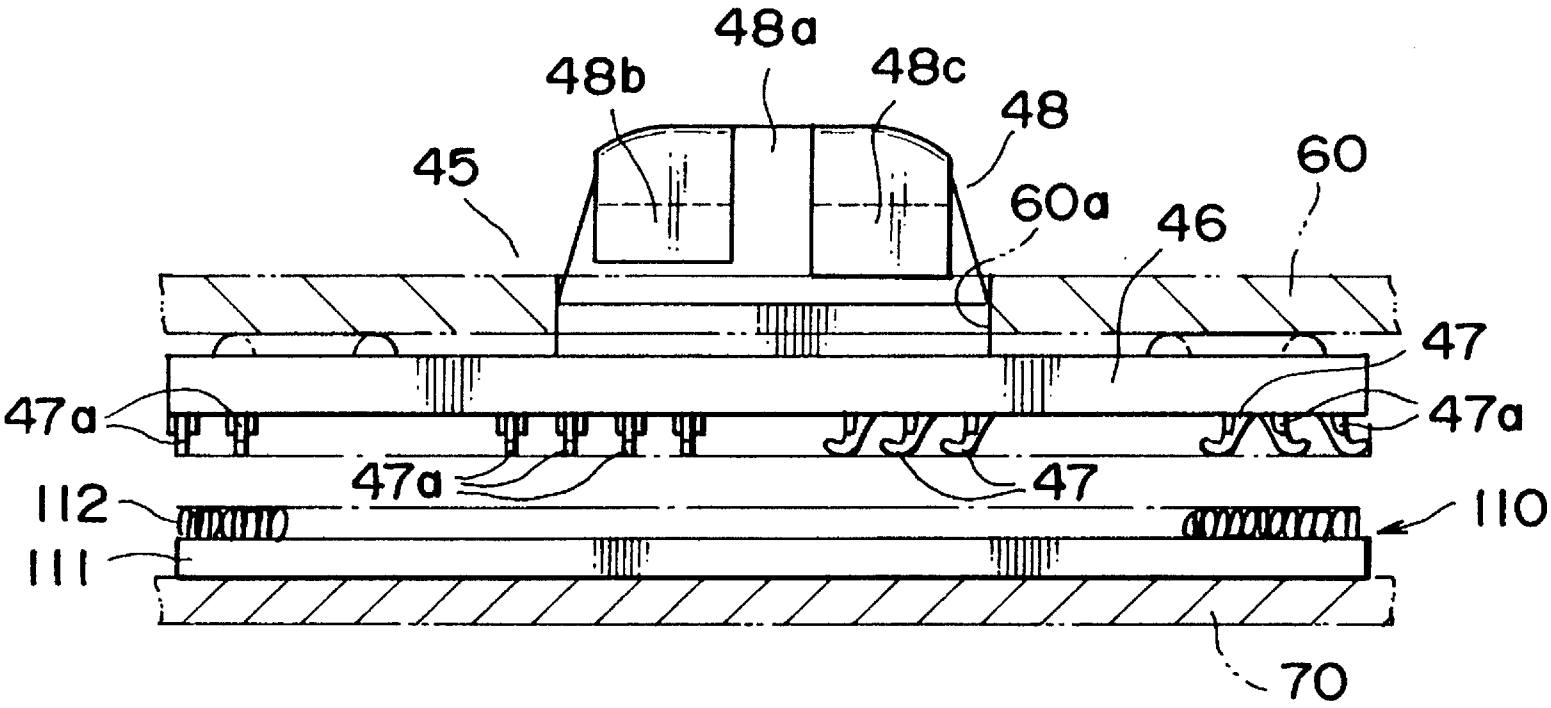
FIG. 7 is a front elevational view of the interior finish material fastening device while in use.
Figure 8:
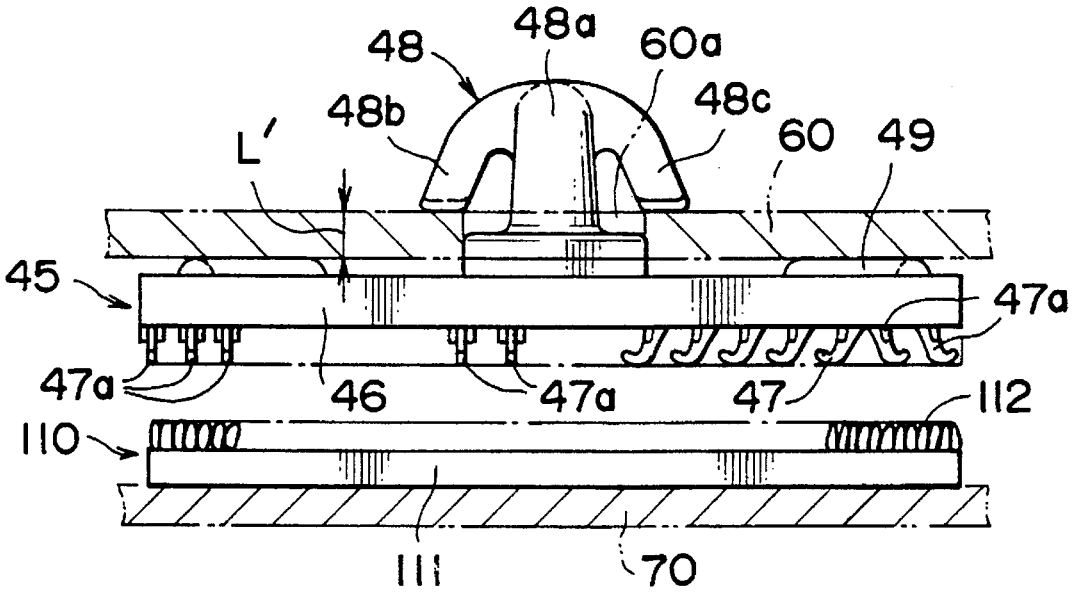
FIG. 8 is a side view of FIG. 7.

Then, a typical embodiment of a fastening device of this invention as applied to a fastener for an automobile interior finish material will be described below with reference to FIGS. 6 through 8, in which FIG. 6 is a plan view of the fastener, FIG. 7 is a front elevational view of the same, and FIG. 8 is a side view of the same. In FIGS. 6–8, the fastener (interior finish material fastener) of this invention generally designated by 45 has a rectangular shape and is adapted to be attached to a body 60 (FIGS. 7 and 8) in the vehicle passenger compartment. Designated by 110 in FIGS. 7 and 8 is a rectangular female fastener piece fixed to an interior finish material 70 of the automobile. The fastener 45 and the female fastener piece 110 include plate-like base members 46 and 111, respectively.

The fastener 45 includes a large number of hooks 47 projecting from one surface (the face) of the base member 46, and a resilient locking portion 48 disposed centrally on the opposite surface (the back) of the base member 46. The resilient locking portion 48 includes a stud-like projection 48*a* formed integrally with the locking portion 48 and having a substantially rectangular transverse cross section. In the illustrated embodiment, the face of the base member 46 is divided into four sections each including a plurality of parallel juxtaposed rows of hooks 47. The hooks in each row R has the same hook direction with the exception described later and are aligned with an axis of the hook row. The hook directions of the hooks 47 disposed in one section are perpendicular to the hook directions of the hooks 47 disposed in an adjacent section (that is, the axis of each row R of hooks 47 in one section is perpendicular to the axis of each row R of hooks 47 in an adjacent section). Furthermore, the hooks 47 in one row R has a hook direction which is opposite to the hook direction of the hooks 47 of an adjacent row R. Moreover, of the hooks 47 in each row R extending perpendicular to a peripheral edge of the base member 46 and having a hook direction facing inwardly of the base member 46, outermost two hooks 47*a* which are adjacent to the peripheral edge of the base member 46 are directed outwardly of the base member 46, as shown in FIGS. 7 and 8. Thus, in respect of the hook rows R extending perpendicular to the peripheral edge of the base member 46, the hooks 47*a* standing in two hook tiers extending along the peripheral edge of the base member 46 are all directed outwardly.

In the case of the conventional type of the fastener 45, if it were not for the arrangement of this invention, those hooks 47 disposed adjacent to the peripheral edge of the base member 46 are likely to become fatigued to a greater extent than other hooks 47 when they are subjected to a repeated load. In addition, since peeling operation proceeds in a direction from the peripheral edge toward a central portion of the base member 46 when the interior finish material 70 is peeled off from the fastener 45, the hooks 47 which are directed inwardly of the base member can only exhibit a weak peeling resistance at the initial stage of the peeling operation and eventually lower the overall peeling strength of the fastener.

Figure 9:
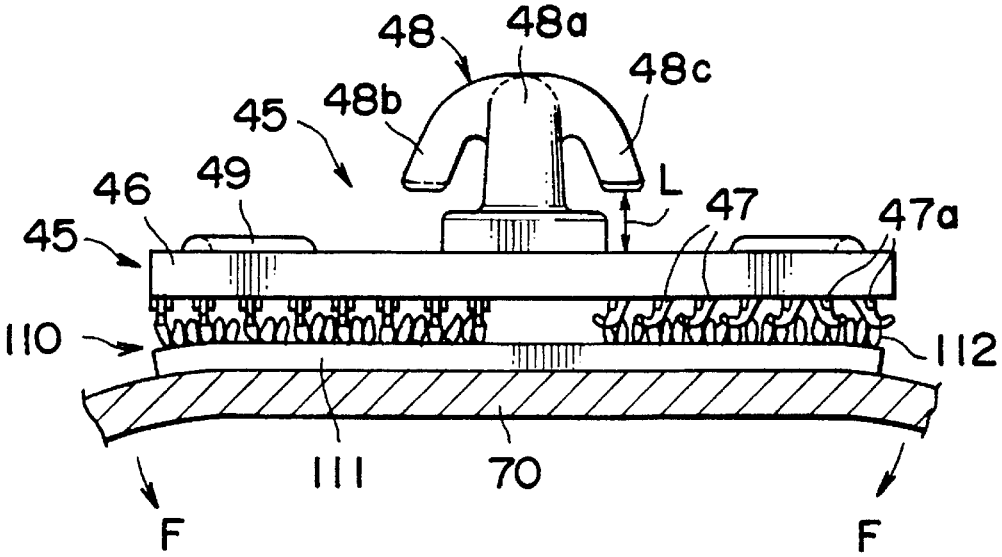
FIG. 9 is a view similar to FIG. 8, showing the operation of the fastening device.
Figure 10A:
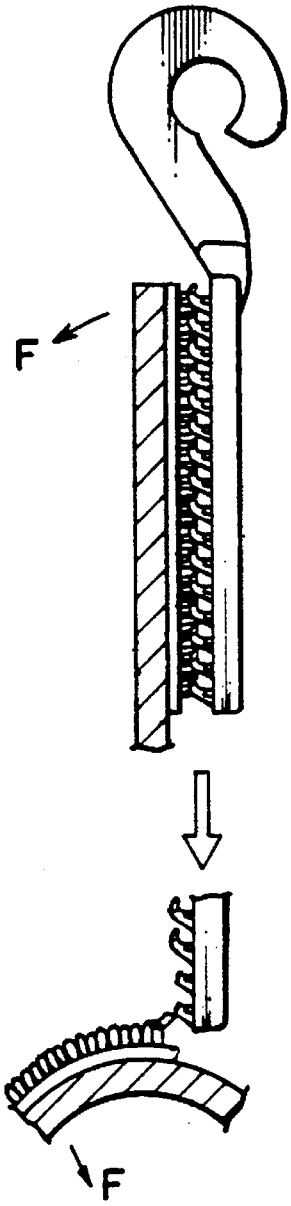
FIG. 10(A) PRIOR ART
FIGS. 10(A) and 10(B) are views illustrative of problems associated with a prior screen hanging fastener and a prior interior finish material fastener, respectively.
Figure 10B:
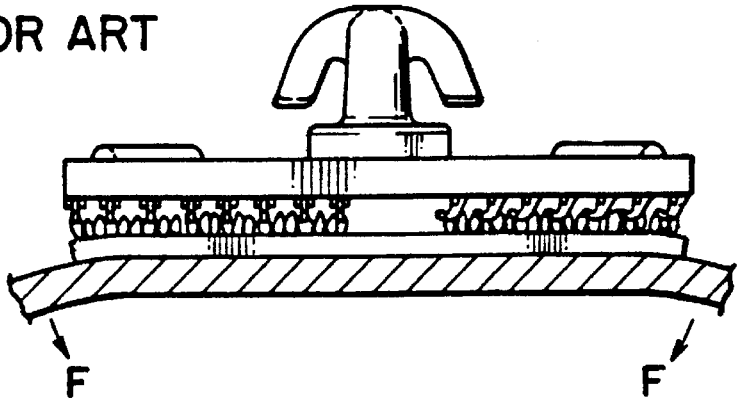
FIG. 10(B) PRIOR ART

However, according to the present invention, those hooks 47*a* which are disposed in the hook rows R extending perpendicular to the peripheral edge of the base member 46 and which stand in two hook tiers extending along the peripheral edge of the base member 46 are all directed outwardly, as described above. With this arrangement, an external force exerted on the interior finish material 70 is evenly born by the hooks 47*a* so that the possibility of these hooks' becoming fatigued can be reduced correspondingly. In addition, when the interior finish material 70 is peeled off in a direction from the peripheral edge toward a central portion of the base member 46, the outwardly directed outermost two hooks 47*a* in each row serve to increase the initial peeling resistance even if the rest of the hooks 47 in the same row are all directed inwardly of the base member 46, as shown in FIG. 9. By virtue of the outwardly directed hooks 47*a*, the overall peeling strength of the fastener 45 is increased.

The stud-like projection 48*a* of the resilient locking portion 48 has a substantially rectangular transverse cross-sectional shape, as described above, and is provided with two pairs of resilient wings 48*b*, 48*c* curved downwardly from the top of the stud-like projection 48*a* and disposed at opposite ends of a major axis of the rectangle, with the resilient wings 48*b*, 48*c* in each pair disposed on opposite sides of the stud-like projection 48*a*. The downwardly curved or retreated resilient wings 48*b* and 48*c* have different lengths, and in the illustrated embodiment the wings 48*b* are longer than the wings 48*c*. More particularly, as shown in FIGS. 8 and 9, the two pairs of resilient wings 48*b*, 48*c* are arranged such that two diagonally opposed resilient wings 48*b* and 48*b*; 48*c* and 48*c* have the same length, and a minimum distance L (FIG. 9) between the longer resilient wings 48*b* and the base member 46 is substantially equal to the thickness of the body 60.

The base member 46 has on its back four rib-like ridges 49 extending along four corners of the rectangular base member 46. Due to the presence of the ridges 49, the aforesaid minimum distance corresponds to a distance L' (FIG. 8) between the front ends of the longer resilient wings 48*b* and the tops of the ridges 49 on the base member 46. The base member 46, hook 47, stud-like projection 48*a*, resilient wings 48*b*, 48*c* and rib-like ridges 49 are integrally formed by injection molding. The base member 111 of the female fastener piece 110 has a rectangular shape substantially the same in size as the rectangular fastener 45 and is provided with a large number of loops 112 formed by a method well known per se.

The fastener 45 of this invention and the female fastener piece 110 jointly form a surface-type fastener. Accordingly, when the fastener 45 and the female fastener piece 110 are forced into face-to-face contact with each other, they are firmly engaged together over the entire area thereof.

When the surface-type fastener of the foregoing construction is used for attaching an interior finish material 70 to an automobile body 60 such as a ceiling or a door panel, the female fastener piece 110 is fixed by a suitable bonding agent, such as an adhesive or a pressure-sensitive adhesive, to a predetermined position on the interior finish material 70 with the loops 112 facing outwards.

The fastener 45 is attached to the body 60 by forcing the resilient locking portion 48 into a rectangular hole or opening 60*a* in the body 60. During that time, since an upper end of the resilient locking portion 48 is tapered due to the provision of the downwardly curved resilient wings 48*b*, 48*c*, the resilient wings 48*b*, 48*c* are gradually flexed inwardly toward each other as the resilient locking portion 48 advances. A further advancing movement of the resilient locking portion 48 causes the stud-like projection 48*a* to move into fitting engagement with the rectangular opening 60*a*. Substantially at the same time, the resilient wings 48*b*, 49*c* pass through the opening 60*a* whereupon they are allowed to flex outwards over the back of the body 60 due to their own resiliency. In this instance, the front ends of the longer resilient wings 48*b* are held in pressure contact with the back of the body 60 in the vicinity of the rectangular opening 60*a*. Thus, the fastener 45 is firmly attached to the body 60 with the body 60 gripped between the resilient locking portion 48 and the rib-like ridges 49 on the base member 46 of the fastener 45.

By virtue of the presence of the rib-like ridges 49, the base member 46 of the fastener 45 and the body 60 jointly define a space which allows the base member 46 to be resiliently flexed toward the body 60 when the fastener 45 is attached to the body 60. This resilient flexing of the base member 46 ensures the complete passage of the resilient wings 48*b*, 48*c* through the opening 60*a* of the body 60, leading to a reliable engagement between the resilient wings 48*b*, 48*c* and the body 60. After the fastener 45 is attached to the body 60, the flexed base member 46 has resilient force in the direction away from the body 60, thereby increasing the tightness of engagement between the fastener 45 and the body 60.

Then, the loops 112 of the female fastener piece 110 fixed to the interior finish material 70 is forced against the hooks 47, 47*a* of the fastener 45 attached to the body 60 whereupon the loops 112 and the hooks 47, 47*a* are engaged together over the entire area of the base members 111, 46. Thus interior finish material 70 is firmly attached to the body 60.

As previously mentioned, the opening 60*a* formed in the body 60 generally has a burr (not shown) at the peripheral edge thereof so that the depth of the opening 60*a* is, in many cases, not the same as the thickness of the body 60 but greater than the thickness of the body 60. If the depth of the opening 60*a* exceeds the thickness of the body 60, the resilient locking portion 48 of the conventional fastener cannot pass through the opening 60*a*, failing to attach the fastener to the body 60. In contrast, according to this invention, since the wings 48*b*, 48*b* have different lengths, and since diagonally opposed two wings 48*b* and 48*b*; 48*c* and 48*c* have the same length, at least the two diagonally opposed shorter wings 48*c*, 48*c* can be moved through the opening 60*a* and then brought into interlocking engagement with the back of the body 60 even when the longer wings 48*b*, 48*b* are prevented from moving through the opening 60*a* due to interference with the burr.

The rib-like ridges 49 provided on the base member 46 do not form an essential part of this invention and hence may be omitted. When the base member 46 has a square shape or a circular shape, the rib-like ridges 49 may be provided along the peripheral edge of the square or circular base member at predetermined intervals. For a base member having a triangular shape, the rib-like ridges 49 should preferably disposed at the corners of the triangular base member. In all cases, the interior finish material 70 may be flat or curved spherically. In addition, the base member 46 may have through-holes or grooves formed to increase the elasticity thereof.

It is apparent from the foregoing description that the fasteners of this invention have a one-piece, integrally molded structure and hence can be manufactured efficiently. Further, since all parts of the fastener are formed from the same material, the fastener is able to meet various requirements such as coloring in a desired tone well matched with the design on a curtain used in combination with the fastener. The fastener is highly attractive in appearance and excels in quality.

In the case of the fastener used for hanging a curtain or the like screen, at least one hook which is located at an end of each row of hooks is directed outwardly of a peripheral edge of the curtain hanging fastener. With this arrangement, even though the hooks are formed by molding, the end hook is no longer subjected to undue force or stress tending to break or fracture the end hook, so that the hook is highly durable and able to withstand a repeated stress.

In an another form of application, the fastener of this invention is used as a fastener for attaching an interior finish material to the body panel of an automobile. In this case, since in each row of hooks extending perpendicular to the peripheral edge of a base member, at least an outermost hook located adjacent to the peripheral edge is directed outwardly of the peripheral edge, an external force exerted on the interior finish material is born evenly by the outermost hooks extending along the peripheral edge. The outermost hooks are unlikely to become fatigued. Further, when the interior finish material is progressively peeled off in a direction from the peripheral edge toward a central portion of the base member, the outwardly directed outermost hooks in one row exhibit a greater initial peeling resistance and eventually increase the overall peeling strength of the fastener even when the rest of the hooks in the same row is directed inwardly of the peripheral edge.

Obviously, various minor changes and modifications of the present invention are possible in the light of the above teaching. It is therefore to be understood that within the scope of the appended claims the invention may be practiced otherwise than as specifically described.

What is claimed is:

1. A fastening device molded of synthetic resin and adapted to be engaged with a fastener part of a mating member, said fastening device comprising a base member having on its one surface a number of hooks integrally molded with said base member and arranged in a plurality of parallel hook rows perpendicular to a first peripheral edge of said base member, the hooks in each hook row of said plurality of parallel hook rows having a hook direction aligned with an axis of the respective hook row, the hooks in one hook row of said plurality of parallel hook rows and the hooks in an adjacent hook row of said plurality of parallel hook rows having a different pattern of hook directions along their respective axes, wherein in each hook row of said plurality of parallel hook rows, at least one hook closest to said first peripheral edge has a hook direction facing outwardly toward said peripheral edge.

2. A fastening device according to claim 1, wherein said mating member is a hanging screen, and wherein said fastening device further includes a round hook portion having a neck formed integrally with an upper end of said base member, and those hooks which are disposed along a lower end edge of said base member have a hook direction facing downwards.

3. A fastening device according to claim 2, wherein said round hook portion has an opening defined between said neck and a tip end of said round hook portion, and said round hook portion further includes a beak-like straight portion contiguous to said tip end and extending radially outwardly therefrom substantially at right angles to said round hook portion.

4. A fastening device according to claim 1, wherein said mating member is a plate-like interior finish material, and wherein said base member has a certain degree of rigidity, said fastening device further includes a stud-like projection disposed centrally on the other surface of said base member and on which a wing-like resilient locking portion is formed at a front end thereof for locking engagement with a mounting member to which said interior finish material is to be attached, and said resilient locking portion is adapted to be forced through an opening in said mounting member to attach said fastening device to said mounting member.

5. A fastening device according to claim 4, wherein said resilient locking portion is composed of at least two pairs of wings disposed in parallel juxtaposition on the front end of said stud-like projection, and one of two adjacent ones of said resilient wings is longer than the other of said two adjacent resilient wings.

6. A fastening device to be engaged with a fastener part of a mating member, said fastening device comprising:

a base member having a first surface, and a polygonal periphery having a plurality of contiguous linear peripheral edges, a plurality of rows of hooks extending in lines perpendicular toward a first peripheral edge of said peripheral edges, forming a rectangular sector of hooks, with a majority of hooks in each row having a respective majority hook direction which is aligned with said lines, a first plurality of hooks in said rectangular sector having a hook direction toward said first peripheral edge and a second plurality of hooks having a hook direction away from said first peripheral edge, wherein a last hook of every row in said rectangular sector which is closest to said first peripheral edge has a preselected hook direction facing outwardly toward said first peripheral edge.

7. The fastening device according to claim 6, wherein said penultimate hook of every row within said rectangular sector, adjacent said first peripheral edge has said preselected hook direction facing outwardly toward said peripheral edge.

8. The fastening device according to claim 6, wherein said respective majority hook direction is reversed for every pair of adjacent hook rows.

9. The fastening device according to claim 6, wherein said respective majority hook direction is universally away from said peripheral edge.

10. A fastening device adapted to be engaged with a fastener part of a mating member, comprising:

a base member being in the shape of a rectangle having four peripheral edges;

a plurality of hooks arranged on said base member extending from said surface, said hooks arranged in closely spaced parallel rows, said rows oriented perpendicularly to a first peripheral edge of said base member, said hooks in said rows forming a rectangular sector of hooks on said surface, wherein a first subplurality of hooks of said plurality of hooks within said rectangular sector have a hook direction facing away from said first peripheral edge, and a second subplurality of hooks of said plurality of hooks within said rectangular sector have a hook direction facing toward said peripheral edge, and wherein all hooks of said plurality of rows within said rectangular sector which are closest to said peripheral edge have a hook direction facing outward toward said first peripheral edge.

11. The fastening device according to claim 10, wherein penultimate hooks of all hook rows within said rectangular sector have a hook direction facing outwardly towards said first peripheral edge.

12. The fastening device according to claim 11, wherein except for the hooks closest to said peripheral edge and said penultimate hooks of all hook rows, all hooks along each row of said plurality of hooks have a consistent hook direction, and said consistent hook direction is reversed for every pair of adjacent hook rows.

13. A fastening device adapted to be engaged with a fastener part of a mating member, comprising:

a base member having a rectangular shape with a plurality of peripheral edges and a engaging surface;

a plurality of hooks extending from said engaging surface and arranged in a plurality of closely spaced, parallel hook rows in a rectangular sector on said engaging surface, said hook rows arranged perpendicularly to a first peripheral edge, wherein all hooks of said hook rows within said rectangular sector have a hook direction facing away from said first peripheral edge except for a subplurality of hooks located within a narrow band adjacent said first peripheral edge which all have a hook direction facing toward said first peripheral edge.

14. The fastening device according to claim 13, wherein said subplurality of hooks within said narrow band include two hooks within each row of said plurality of rows within said rectangular sector.

15. The fastening device according to claim 13, wherein said narrow band comprises one hook from each row of hooks within said rectangular sector that is closest to said first peripheral edge.

* * * * *